US006708426B2

(12) United States Patent
Erickson et al.

(10) Patent No.: US 6,708,426 B2
(45) Date of Patent: Mar. 23, 2004

(54) TORSION MANAGEMENT OUTSOLES AND SHOES INCLUDING SUCH OUTSOLES

(75) Inventors: John J. Erickson, Brockton, MA (US); Douglas K. Robinson, Mansfield, MA (US); Joseph Hamill, Florence, MA (US); Saunders N. Whittlesey, Deerfield, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/047,320

(22) Filed: Jan. 14, 2002

(65) Prior Publication Data

US 2003/0131501 A1 Jul. 17, 2003

(51) Int. Cl.[7] ..... A43B 13/14

(52) U.S. Cl. ..... 36/127; 36/102; 36/103; 36/30 R; 36/25 R

(58) Field of Search ..... 36/127, 102, 103, 36/104, 30 R, 33, 86, 25 R, 31

(56) References Cited

U.S. PATENT DOCUMENTS

| | | | | | |
|---|---|---|---|---|---|
| 4,497 | A | * | 5/1846 | Vetter | 36/7.1 R |
| 1,964,406 | A | * | 6/1934 | Pellkofer | 36/11.5 |
| 2,252,315 | A | * | 8/1941 | Doree | 36/9 R |
| 2,361,511 | A | * | 10/1944 | Stritter | 36/31 |
| 2,362,010 | A | * | 11/1944 | Huff | 36/91 |
| 2,669,036 | A | * | 2/1954 | Israel | 36/11.5 |
| 3,550,597 | A | | 12/1970 | Coplans | 128/585 |
| 4,177,582 | A | * | 12/1979 | Ehrlich, Jr. | 36/33 |
| 4,400,894 | A | * | 8/1983 | Ehrlich | 36/33 |
| 4,608,970 | A | | 9/1986 | Marck et al. | 128/80 J |
| 4,944,099 | A | * | 7/1990 | Davis | 36/97 |
| 5,243,776 | A | | 9/1993 | Zelinko | 36/134 |
| 5,718,063 | A | * | 2/1998 | Yamashita et al. | 36/28 |
| 5,815,949 | A | * | 10/1998 | Sessa | 36/3 B |
| 5,979,083 | A | * | 11/1999 | Robinson et al. | 36/127 |
| 6,076,284 | A | * | 6/2000 | Terlizzi | 36/103 |
| 6,115,945 | A | * | 9/2000 | Ellis, III | 36/102 |
| 6,233,846 | B1 | * | 5/2001 | Sordi | 36/28 |
| 6,516,541 | B2 | * | 2/2003 | Cagner | 36/102 |

* cited by examiner

*Primary Examiner*—Ted Kavanaugh

(57) ABSTRACT

The present invention is directed to an outsole for use with a shoe and a shoe having an improved outsole. The outsole includes a forward portion and a rearward portion that are connected by a ball-and-socket connection that allows the portions to move freely. The outsole may include a flexible member disposed between two pieces, for example, of the forward portion to allow these pieces to flex freely. The outsole may be used with a sole construction that includes a gel cushion that is adjacent a transparent window member of the outsole.

21 Claims, 12 Drawing Sheets

TORSION MANAGEMENT OUTSOLES AND SHOES INCLUDING SUCH OUTSOLES

TECHNICAL FIELD

The present invention is directed to an outsole. More particularly, the present invention is directed to a golf shoe having an improved outsole that enables greater torsional movement and flexibility of the shoe.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal. In this manner, golf shoes have evolved to provide the wearer with good traction on grass, comfort while walking, and a stable platform for hitting the ball. Typical golf shoes thus have a relatively stiff sole with metal spikes or plastic cleats.

A stiff sole, while providing a stable platform, can nonetheless cause discomfort because there is a balance between how the foot should be allowed to move versus how it should be supported. An example of this is the fact that during walking and at the start and finish of the golf swing, the foot bends at the metatarsal joints (the ball). Aside from the physical effort needed to flex a very stiff sole (which would tend to cause a 'clunky' gait as when wearing clogs), sole stiffness tends to cause the heel of the foot to slide up and down in the heel cup, potentially causing blisters. Thus, golf shoes have evolved to have soles that flex across the ball area to allow this movement without compromising the lateral stability of a good hitting platform.

Relatively recent studies in biomechanics have sought to better quantify how the 26 bones of the foot move relative to each other during human movements. One particular motion that has been identified is a torsional movement about the long axis of the foot. In effect, the forefoot and rearfoot twist relative to each other. It is thought that this movement smooths the contact between foot and ground, decreasing impacts with the ground as well as providing better ground contact. This observation has led to the development of a golf shoe sole to allow this natural movement.

U.S. Pat. No. Re. 33,194, reissued from U.S. Pat. No. 4,608,970, to Marck et al. discloses an orthopedic device for correcting infants' feet. The device includes a posterior part, an anterior part, and a ball-and-socket for allowing three degrees of freedom between the posterior and anterior parts during set-up. These parts are immobilized in a particular position, when the device is in use. As a result, this device does not assist with the natural torsional-like action of the foot in walking where such action is missing.

U.S. Pat. No. 3,550,597 discloses a device that facilitates the natural rolling action of the foot during movement by providing a flat construction with front and rear main lifting sections rigidly connected to a resilient intermediate section that is twisted into the form of a flat torsion spring. The device applies a yieldable torsional action during use that is applied to the foot by the lifting sections, whereby the heel of the foot is urged upwardly at the inner side and the forefoot is raised upwardly at the outer side, producing a torsional action similar to the natural torsion action of the foot.

Another construction intended to provide greater support to the wearer of the shoe is disclosed in U.S. Pat. No. 5,243,776 to Zelinko. The Zelinko golf shoe has a sole having a forward end, a heel end and an intermediate portion joining the two ends. A spike support plate is journaled to a post extending from the forward end of the shoe. The spike support plate is so mounted to the forward end for rotation about a vertical axis. A biasing means, such as tension springs, is provided to connect the spike support plate to the heel end and for constantly biasing the spike support plate to a neutral (i.e., non-rotated) position and returning the support to that position after the support has been rotated. A cover is provided to protect the biasing means. The Zelinko golf shoe is constructed to allow the forward end of a golfer's foot to remain fixed during a golf swing while the heel rotates.

There remains a need for an improved outsole for a shoe that enables individuals movements of the foot, particularly, the rotation between the rearfoot and the forefoot. By allowing and controlling these rotations, the outsole would resists torsional instability during play, provides independent traction suspension, and increases the flexibility of the shoe to accommodate the movement of the wearer.

SUMMARY OF THE INVENTION

The present invention is directed toward an outsole for a shoe construction having a forward portion, and a rearward portion, coupled together at a pivot point. The forward and rearward portions are operatively connected to freely allow independent and relative movement of the forward and rearward portions about the pivot point. This relative movement may occur during a user walking with the outsole or swinging a golf club.

In another embodiment, the outsole further comprises a first axis extending substantially longitudinally across the outsole and through the pivot point and the forward and rearward portions are moveable about the first axis. In yet another embodiment, the outsole further includes a second axis extending through the pivot point and offset with respect to the first axis and the forward and rearward portions are moveable about the second axis. In one embodiment, the second axis is offset at an angle between about 5° and about 30° and in another embodiment the pivot point is positioned adjacent the exterior of the outsole.

In one embodiment, the forward and rearward portions may be operatively connected discrete pieces. In another embodiment, the outsole may include a ball-and-socket connection configured to allow relative movement of the forward and rearward portions.

In yet another embodiment, the present invention is directed to a shoe comprising an outsole and an upper generally configured to accommodate a foot connected to the outsole. The outsole includes a forward portion for supporting the forefoot of a foot and a rearward portion for supporting the heel of the foot. The forward portion defines a chamber. The rearward portion includes a protrusion. The forward and rearward portions are operatively connected when the protrusion is received in the chamber.

In another embodiment, the present invention includes an outsole comprising a first piece, a second piece separate from the first piece, and a flexible member joining the first piece to the second piece. The flexible member includes a length that is less than the length of each of the first and second pieces. Furthermore, the material of the flexible member is substantially softer than the first and second piece materials.

In such an outsole, the first and second piece materials may have a Shore A greater than about 75 and the flexible member material may have a Shore A less than about 85. In addition, in such an outsole the first and second piece materials may have a Shore A greater than about 85 and the flexible member material may have a Shore A of about 70.

The present invention is also directed to a sole construction comprising an outsole having a transparent window member on the upper surface thereof, a midsole for connected to the outsole, and a gel cushion between the outsole and the midsole. At least a portion of the gel cushion may be aligned with the window member.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
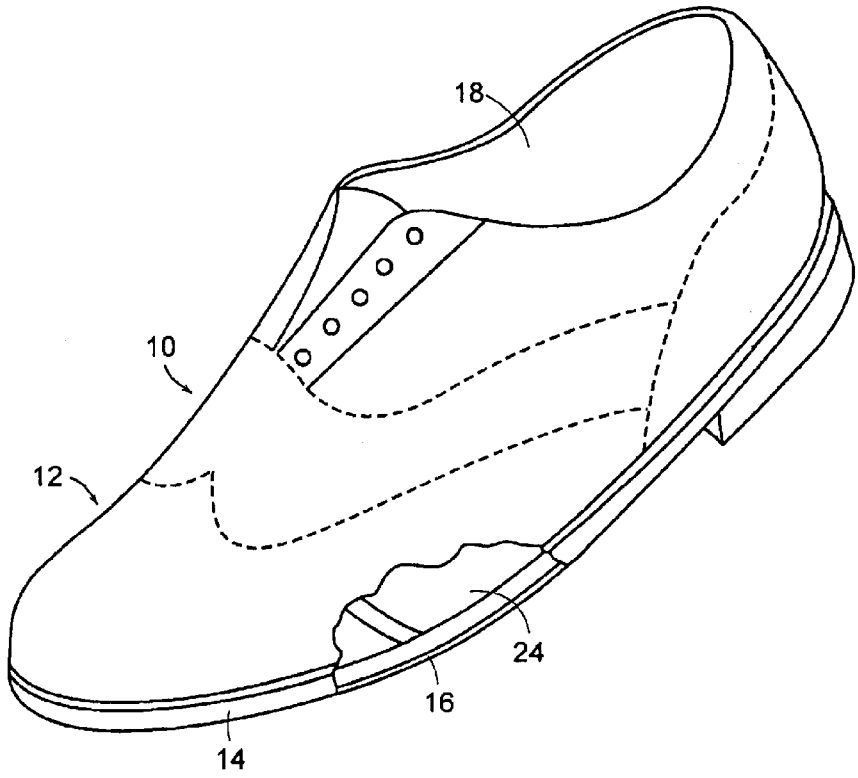
FIG. 1 is a top, perspective view of a golf shoe of the present invention with a portion broken away to expose a midsole.

An embodiment of a golf shoe 10 constructed according to the present invention is shown in FIG. 1. The shoe 10 includes an upper 12, a midsole 14 joined to the upper 12, and an outsole 16 joined to the midsole 14. The upper 12 has a generally conventional shape and is formed from a suitable upper material, such as leather or the like. An opening 18 is formed by the top portion of the upper 12 for receiving a user's foot. Upper 12 is preferably secured to midsole 14 with cement or other adhesives using an insole board and conventional techniques, as known by those of ordinary skill in the art.

The midsole 14 provides cushioning to the wearer, and is formed of a material such as an ethylene vinyl acetate copolymer (EVA). Preferably, the midsole 14 is formed on and about the outsole 16. Alternatively, the midsole can be formed separately from the outsole and joined thereto such as by adhesive. Once the midsole and outsole are joined, the outsole 16 forms a substantial portion of the bottom of shoe 10.

Figure 2:
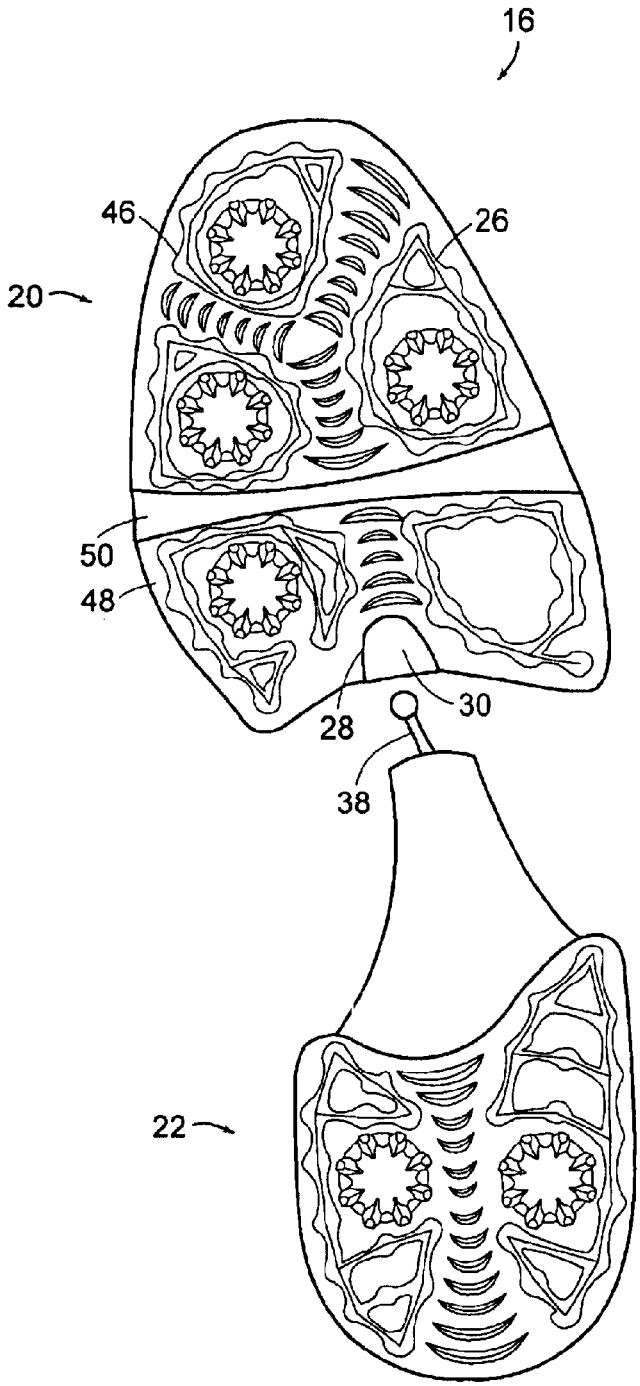
FIG. 2 is an exploded, bottom view of a first embodiment of an outsole of the golf shoe of FIG. 1, wherein a non-metal spike is disassembled therefrom.

Referring to FIG. 2, the outsole 16 includes a forward portion 20 coupled to a separate rearward or shank-heel portion 22. The forward and shank-heel portions 20 and 22 are discrete pieces connected to permit relative movement therebetween. The outsole 16 has a top surface 24 and a bottom surface 26. Midsole 14 is joined to top surface 24. The bottom surface 26 is configured to contact the turf or ground during use.

Figure 3:
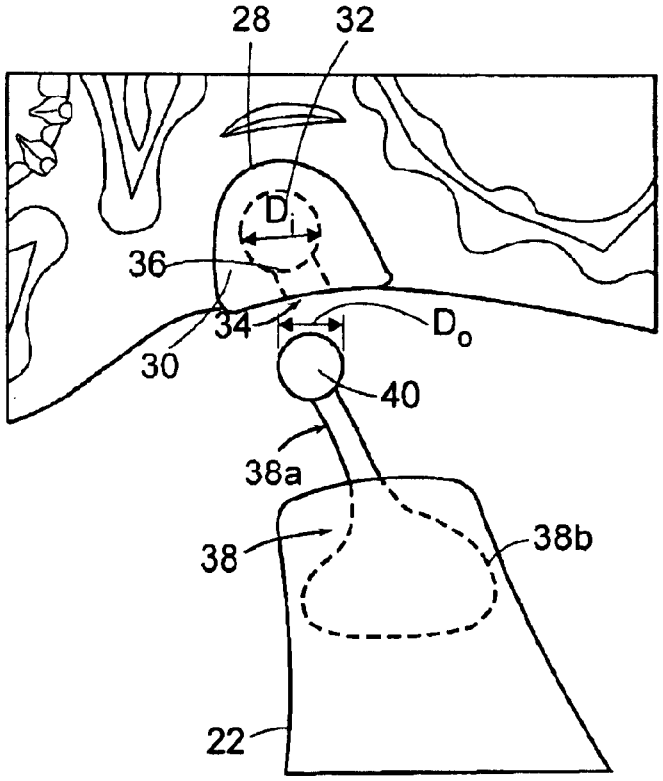
FIG. 3 is an enlarged, bottom view of a portion of the outsole of FIG. 2.

Referring to FIGS. 2 and 3, one preferred mechanism used to couple forward portion 20 to shank-heel portion 22 includes a connector 30 and a male member 38. Connector 30 is positioned at the rearward edge of forward portion 20, and is received in a recess 28 formed in forward portion 20. Preferably, connector 30 has a substantially spherical, interior chamber 32 with an opening 34 and an inner ridge 36. Ridge 36 is preferably spaced from and near the opening 34 within the chamber 32.

Male member 38 extends from the forward edge of shank-heel portion 22 and includes a projection portion **38*a* extending from a base portion 38*b* that is embedded in shank-heel portion 22. In one preferred embodiment, base portion 38*b* is wider than projection 38*a* and may optionally include holes for assuring good molding or adhesion of the male member 38 to shank-heel portion 22**.

Figure 4:
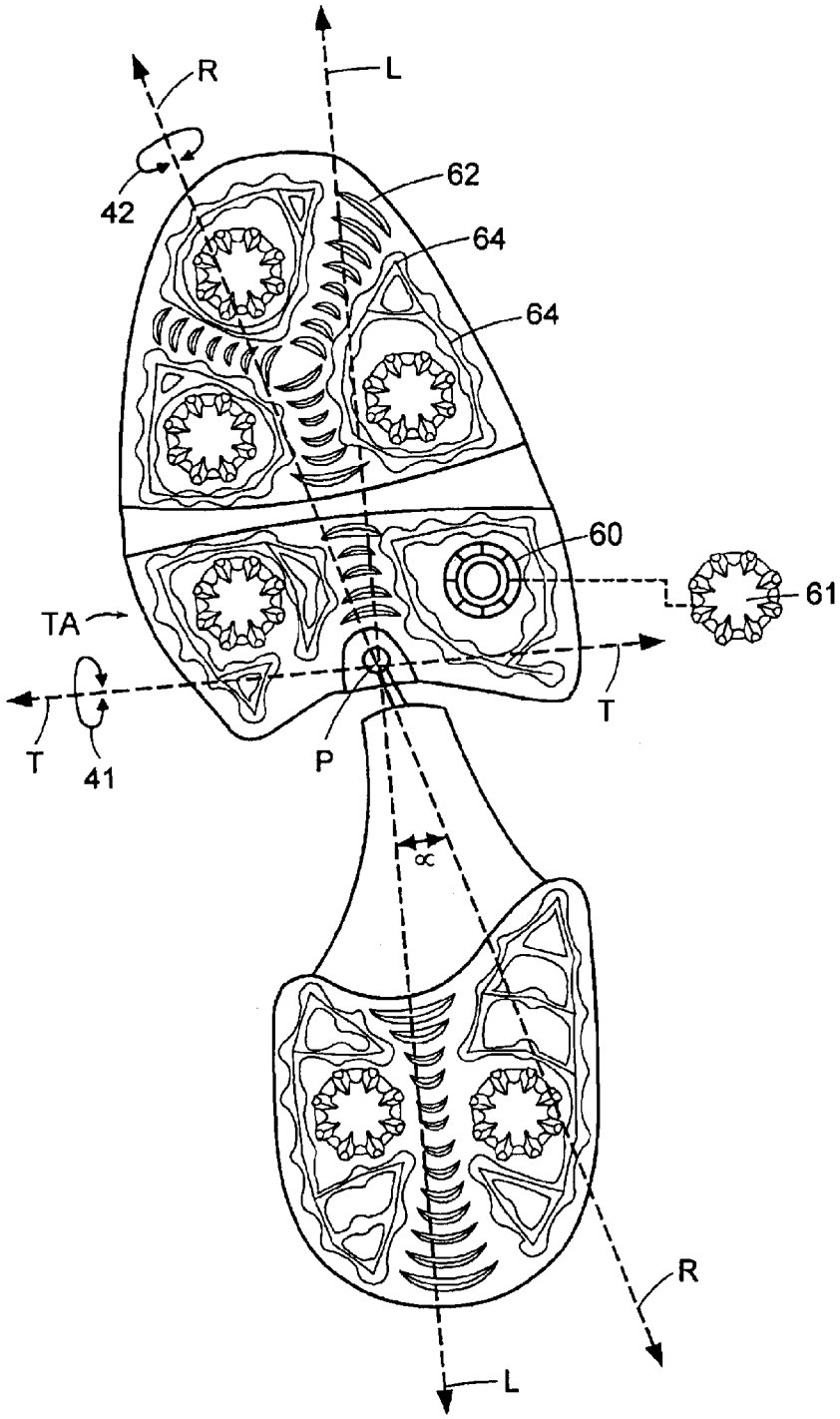
FIG. 4 is a bottom view of the outsole of FIG. 2 according to the present invention, wherein the outsole is assembled and the spike is disassembled therefrom.

The projection portion **38*a* is configured and dimensioned to be received within chamber 32 of connector 30, as shown in FIG. 4. In a preferred embodiment, connector 30 and projection portion 38*a* form a ball-and-socket joint. In this regard, the projection portion 38*a* preferably has a ball 40 at the free end and the spherical chamber 32 serves as the socket. The connector 30 is dimensioned and flexible enough to allow entry of the ball 40 into chamber 32, but also retains the ball 40 within the chamber 32**.

The chamber 32, preferably, has an inner diameter Di. The ball 40 preferably has an outer diameter Do. The chamber 32 inner diameter Di is slightly larger than the ball 40 outer diameter Do such that there is sufficient clearance to allow the ball 40 to rotate in the socket 32. In a preferred embodiment, the outer diameter Do of the ball 40 is between about 5 mm and about 6 mm, and most preferably is about 5.5 mm. The inner diameter Di of the chamber 32 is preferably no more than 0.1 mm greater than the diameter of the outer diameter Do to allow movement between the two pieces without excessive free play.

In a preferred embodiment, the connector 30 may be formed of flexible plastic material. A suitable material for the connector 30 is an ester-based thermoplastic polyurethane manufactured by URE-TECH CO., Ltd. located in Taiwan under the name Utechllan UTY-85A. This material is desirable because it is available as a transparent material so that the ball-and-socket connection is visible from the top and bottom surfaces 24, 26 of the outsole 16. The connector 30 and male member 38 preferably have a hardness of about 90 Shore A.

Figure 6:
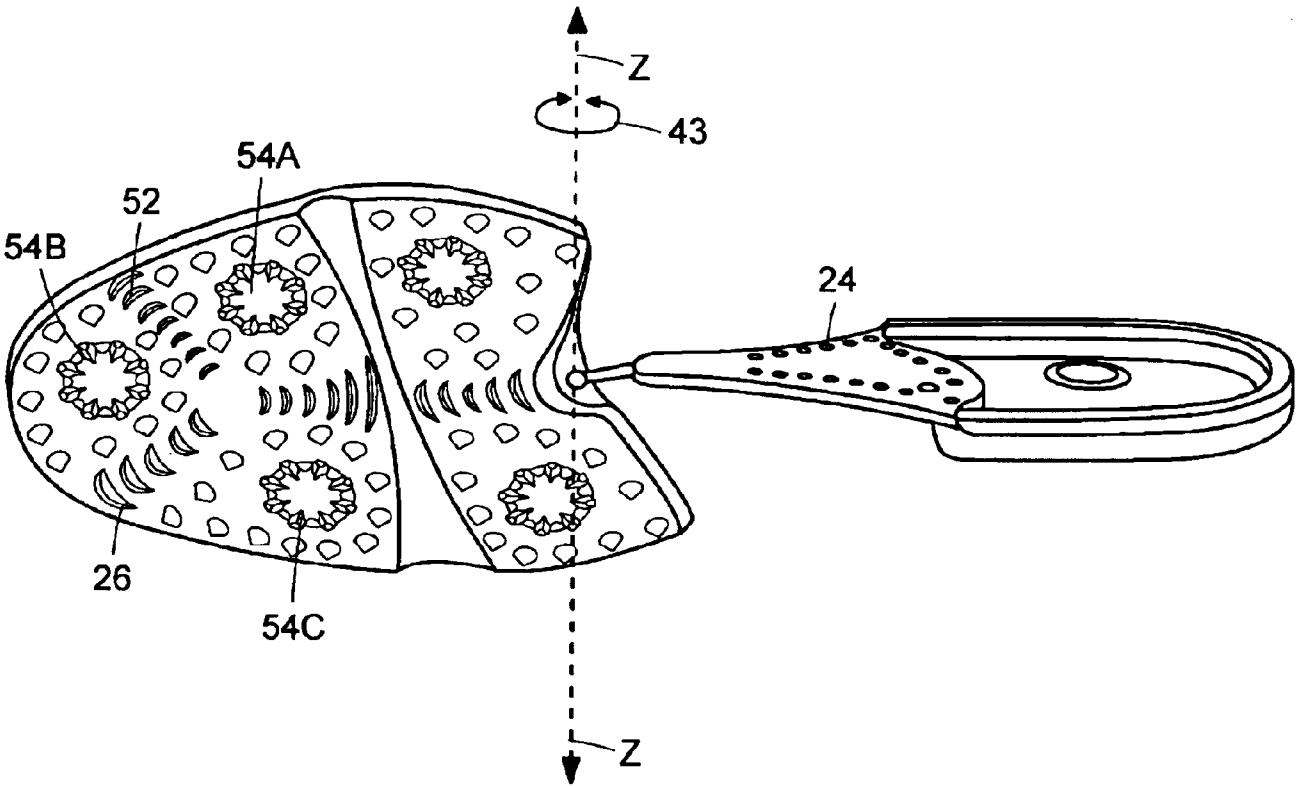
FIG. 6 is a side view of the outsole of FIG. 4 showing the forward portion rotated with respect to the rearward portion.

Referring to FIG. 4, the outsole 16 further includes a longitudinal axis L that extends longitudinally along the center of shank-heel portion 22 through the ball-and-socket connection to the forefoot portion 20 of the outsole 16. A transverse axis T extends transversely across the outsole 16 and through the ball-and-socket connection and is aligned substantially perpendicular to the longitudinal axis L. Referring to FIG. 6, a vertical axis Z extends through the ball-and-socket connection and substantially perpendicular to the bottom surface 26 of the outsole 16 and the longitudinal and transverse axes L and T. Projection portion 38*a* of male member 38 preferably extends along an axis of rotation R that is configured to align with an axis about which the foot naturally rotates or torques during walking and during a golf swing. Projection portion 38*a* and axis R are preferably offset at an angle $\alpha$ of between about 5° and about 30°, most preferably about 15°, with respect to longitudinal axis L.

The ball-and-socket connection defines a pivot point P that is positioned to allow natural rotation between the forefoot and rearfoot during walking and during a golf swing. In a preferred embodiment, the pivot point P is located between the midfoot and forefoot, preferably just behind the transverse arch (TA) of a user at the intersection of the subtalar joint axis and the midtarsal. Pivot point P is also preferably located adjacent the exterior of the outsole. The ball-and-socket connection allows the forward and rearward portions 20 and 22 to move independently, pivotally, and relatively with respect to each other about pivot point P. Also, this connection permits relative movement with three degrees of freedom, i.e. rotation about the axes R, T, and Z, while providing a stable connection therebetween. For example, the forward and rearward portions can rotate about axis R (twist) as indicated by arrow 41, rotate about axis T (move upward and downward) as indicated by arrow 42, and rotate about axis Z (move sideways) as indicated by arrow 43 in FIG. 6. Accordingly, torsional management of the outsole 16 is achieved by allowing the shank-heel portion 22 to move independently of the forefoot portion 20 and thereby minimizing any strain that may be caused when the rolling motion of the wearer's foot is constrained by the shoe while walking or swinging a club. Additionally, the coupled connection provided by the ball-and-socket supports the wearer's foot, further providing comfort thereto. Advantageously, a golfer can keep more shoe sole on the ground during a golf swing by not having the heel portion of the shoe torque or lift the forefoot up off the turf.

Figure 5:
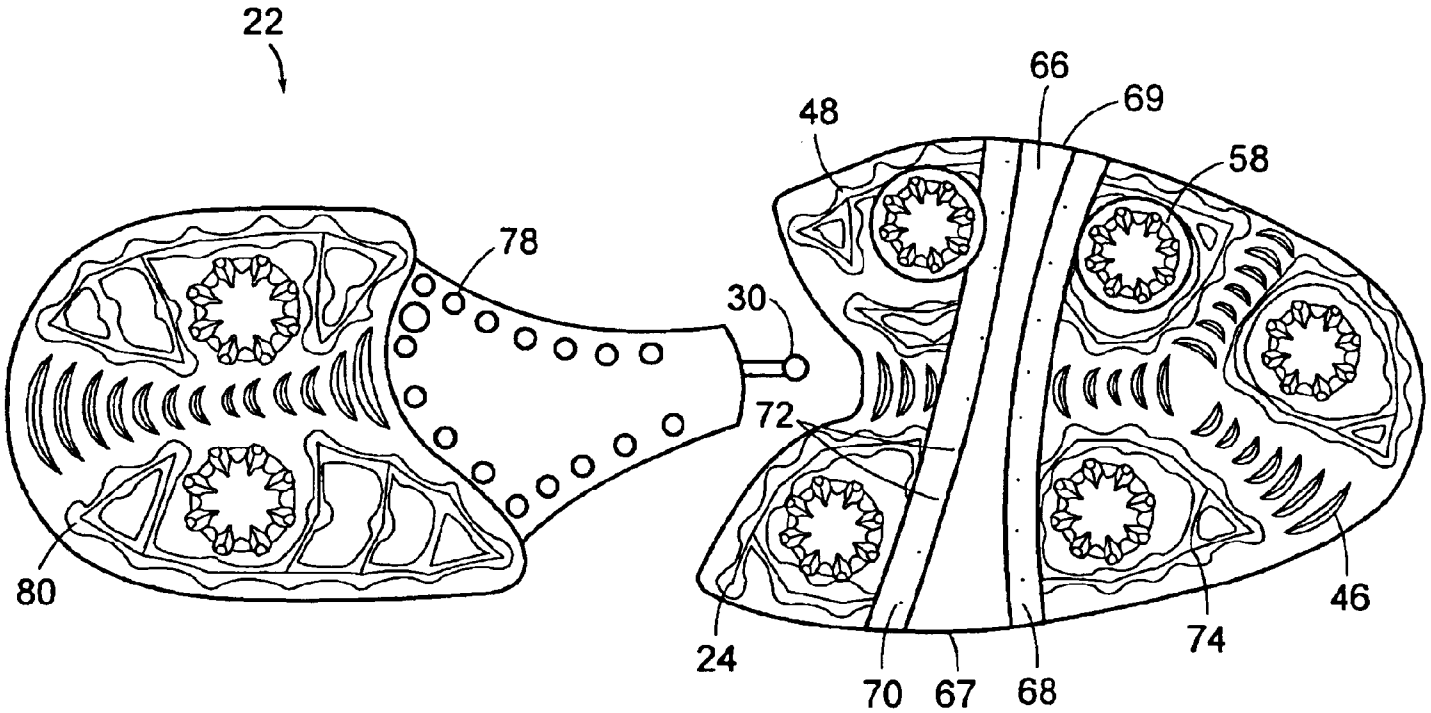
FIG. 5 is a top view of the outsole of FIG. 4.
Figure 7:
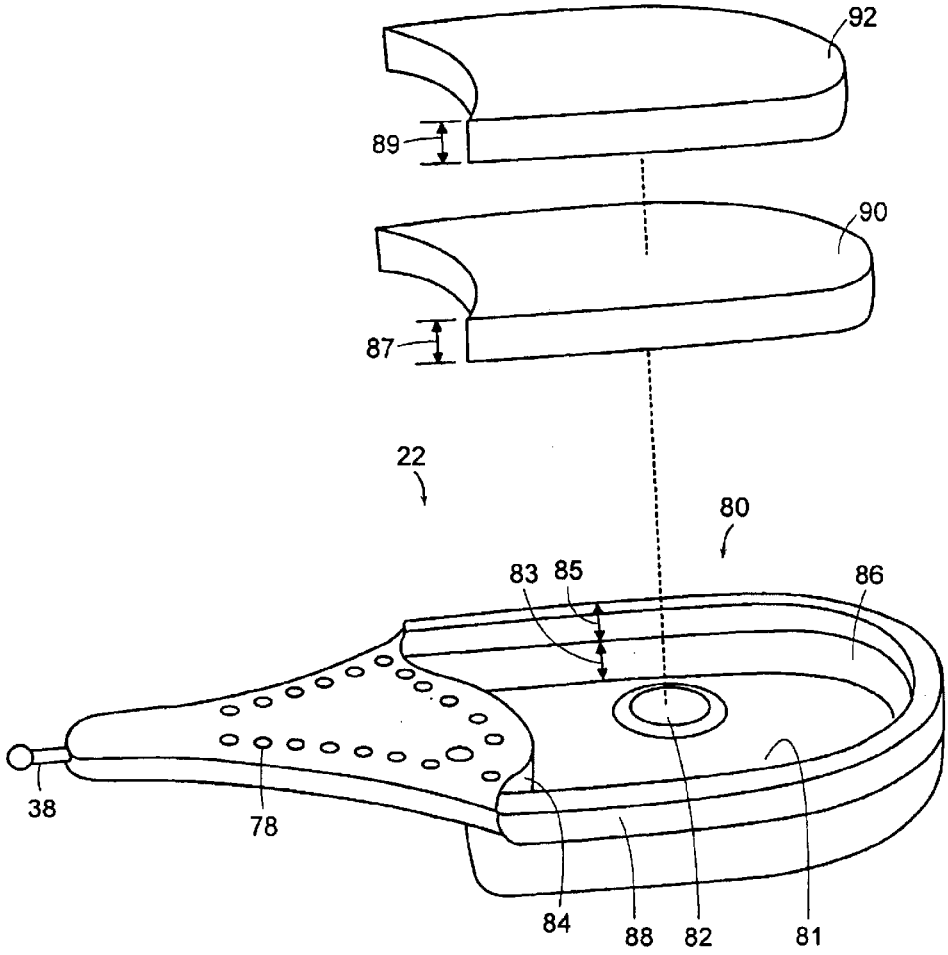
FIG. 7 is an enlarged, partial, perspective view of the rearward portion of outsole of FIG. 4 with a gel cushion and a heel cushion disassembled therefrom.
Figure 9:
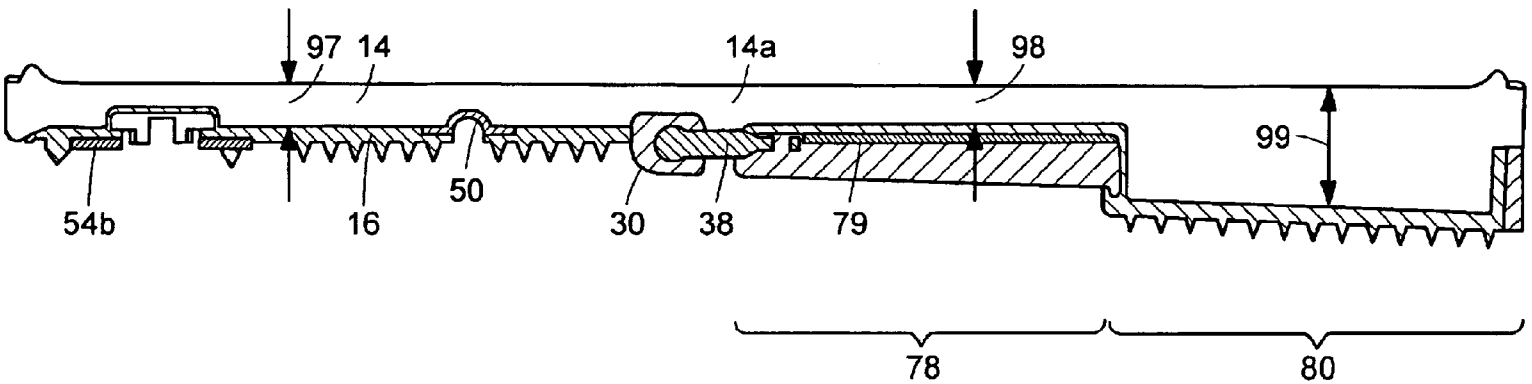
FIG. 9 is a cross-sectional view of the outsole and midsole of FIG. 8 taken along the line I—I.

Referring to FIGS. 5 and 7, the shank-heel piece 22 includes a shank section 78 and a heel section 80. As can be seen in FIG. 9, shank section 78 includes a stiff member 79, preferably embedded within shank section 78, which is positioned to cover a substantial portion of the midfoot. Siff member 79 is preferably made from a kevlar or titanium material, however other stiff material can alternatively be used to have a desirably rigid shank that preferably resists bending. Stiff member 79 does not extend longitudinally into the heel section 80 and allows for the heel to collapse and cushion the wearer's heel during walking. In a preferred embodiment, shank section 78 is trapezoidal in shape having a larger width towards the heel section 80 and narrowing towards the forefoot. During walking and or swinging, the trapezoidal shape of the shank advantageously focuses the torsional forces exerted upon the shank-heel piece 22 toward the ball-and-socket joint and pivot point P. Also, because stiff member 79 is difficult to bend, both transversely and rotationally, shank section 78 preferably transmits substantially all of the torsional forces toward the ball-and-socket joint so that a maximum amount of rotation and bending occurs at a single pivot point P. In alternate embodiments shank sections can be curved, or have other shapes.

Referring to FIG. 2, in one preferred embodiment, the forward portion 20 includes a toe piece 46 and a separate forefoot piece 48. The toe piece 46 and the forefoot piece 48 are connected together by a flexible member 50. The flexible member 50 has a length less than the length of either of the toe piece 46 or the heel piece 48. The shank-heel portion 22 in this embodiment is a single piece. However, the present invention is not limited to this construction and alternative embodiments, the forefoot portion 20 can be formed by a single piece.

It is recommended that the flexible member 50 is located such that it will be substantially below the user's metatarsal bones. The middle of the flexible member 50 is preferably located directly under the metatarsal heads. This optimally allows for variability of the location of the metatarsal heads by being wider than the flexion axis of the metatarsal heads. As a result, the flexible member 50 forms a hinge and the outsole 16 has good longitudinal flexibility for comfort.

Referring to FIG. 5, the flexible connector 50 that couples the toe piece 46 to the forefoot piece 48 includes a central portion 66, a forward portion 68 and a rearward portion 70. The central portion 66 is formed to arch upward (as best seen in FIG. 6). Preferably, the arched shape of the central portion 66 is formed during molding of the central portion 66. In addition, the central portion 66 may be preferably wider at a lateral edge 67 than at a medial edge 69. The central portion may narrow from each edge 67 and 69 toward the center 71 of the outsole.

The forward portion 68 of the connector 50 overlaps a rear section of the toe piece 46 and is joined thereto preferably during molding. The rearward portion 70 overlaps a front section of the forefoot piece 48 and is joined thereto preferably during molding. In this embodiment, projections 72 formed on the toe and forefoot pieces 46 and 48 extend through the forward and rearward portions 68 and 70 of the connector 50 to insure good adhesion between the connector and the pieces 46 and 48.

Referring to FIGS. 5 and 6, the toe piece 46, forefoot piece 48, and shank-heel portion 22 have similar constructions and preferably include a first or base layer 52 and a second layer formed of discrete exterior or second layer pieces 54*a–c* for toe piece 46. In alternate embodiment, these components may also be a single-layer construction.

The base layer 52 of the outsole 16 forms the inner layer of the outsole and is preferably formed from material that is soft for flexibility in the longitudinal direction. Preferably, the exterior or second layer pieces 54*a–c* form the outer layer of the outsole that primarily contacts the ground. Preferably, the second layer material is firm for lateral stability. The first or base layer material may be softer than or equal to the exterior or second layer material in hardness.

The outsole 16 of the present invention may be formed by various conventional methods. For example, one recommended method is disclosed in U.S. Pat. No. 5,979,083 to Robinson et al., which is hereby incorporated by reference in its entirety. According to this method, the first and second layers are molded together.

In the embodiment shown in FIG. 5, sockets 58 retain cleat receptacles 60 (best shown in FIG. 4) therein. The receptacles 60 releasably retain cleats 61 therein. The toe and forefoot pieces 46, 48 and shank-heel portion 22 preferably all include cleat receptacles 60.

Referring again to FIG. 4, the first layer (not shown) further forms sets of projections 62 and 64 that extend therefrom. Sets of projections 62 and 64 are commonly referred to as "spikes" or "cleats," and protrude from the bottom surface of the outsole. These projections 62 and 64 provide traction when the outsole 16 interacts with the ground thereby provide stable support to the golfer especially when the golfer executes a golf shot. These projections 62 and 64 are preferably non-metallic as most golf courses now require that non-metallic spikes or cleats be used with golf shoes.

The set of projections 62 extend from the layer 52 without contacting another layer, while the set of projections 64 extend from the layer 52 and extend through the second layer pieces 54*a–c*. In this embodiment, the projections in the set of projections 64 are interconnected with one another. Similarly projections 74 formed on the second layer pieces 54*a–c* extend through the first layer 52 to insure good adhesion of these components together.

Preferably first or base layer 52 and second layer pieces 54*a–c* materials of the toe piece 46, and forefoot piece 48 and the heel section 80 have a Shore A durometer greater than about 75, more preferably greater than about 85 Shore A, and most preferably of about 95 Shore A±3 Shore A. The preferred first layer and second layer materials for the above components are an ester thermoplastic urethane manufactured by URE-TECH CO., Ltd. located in Taiwan under the name U-95A. Other materials like other thermoplastic polyurethane can also be used including Desmopan® manufactured by Bayer and PEBAX® manufactured by Elf Atochem S.A.

The flexible member 50 may be formed of a thermoplastic urethane that is substantially softer than the first and second layer material for additional flexibility of the forefoot portion 20 (as shown in FIG. 2). Preferably, the flexible member 50 has a hardness of less than about 85 Shore A and more preferably about 70 Shore A. One recommended material is manufactured by URE-TECH CO., Ltd. under the name U-70AP which has a Shore A of about 70±3.

Referring to FIG. 7, the heel section 80 includes a bottom wall 82 and a front wall 84 and side wall 86 extending upwardly therefrom. The walls 82, 84, and 86 of heel section 80 define a recess 81. The side wall 86 has an arcuate shape and a height 83. An arcuate window member 88 is joined to the upper surface of the side wall 86. The height of the arcuate window member 88 is designated as 85. The arcuate window member 88 in this embodiment has a cross-section that is C-shaped, however, the present invention is not limited to this shape.

A heel cushion 90 is configured and dimensioned to fit within the recess 81 and has a thickness 87 substantially equal to the side wall height 83. When assembled, the heel cushion 90 is disposed within the recess 81. A gel cushion 92 is configured and dimensioned to fit within the arcuate window member 88 and has a thickness 89 substantially equal to the window member height 85.

Preferably, the heel cushion 90 is formed of a cushioning material such as EVA, but is not limited thereto and other materials or constructions such as foam, air cushions, and the like can be used. In the preferred embodiment, the window member 88 is formed of clear thermoplastic urethane and the components are configured and dimensioned so that when assembled, the gel cushion 92 is disposed on the heel cushion 90 and the gel cushion 92 is visible through the window member 88. In a preferred embodiment, window member 88 is made from the UTY-90A material mentioned above.

In an alternative embodiment, the heel cushion 90 can be omitted and the gel cushion can have a thickness substantially equal to the side wall height 83 combined with the window member height HWM. As a result, the cushions 90 and 92 are disposed substantially below the user's calcaneus bone 94 (as shown in FIG. 6).

Figure 8:
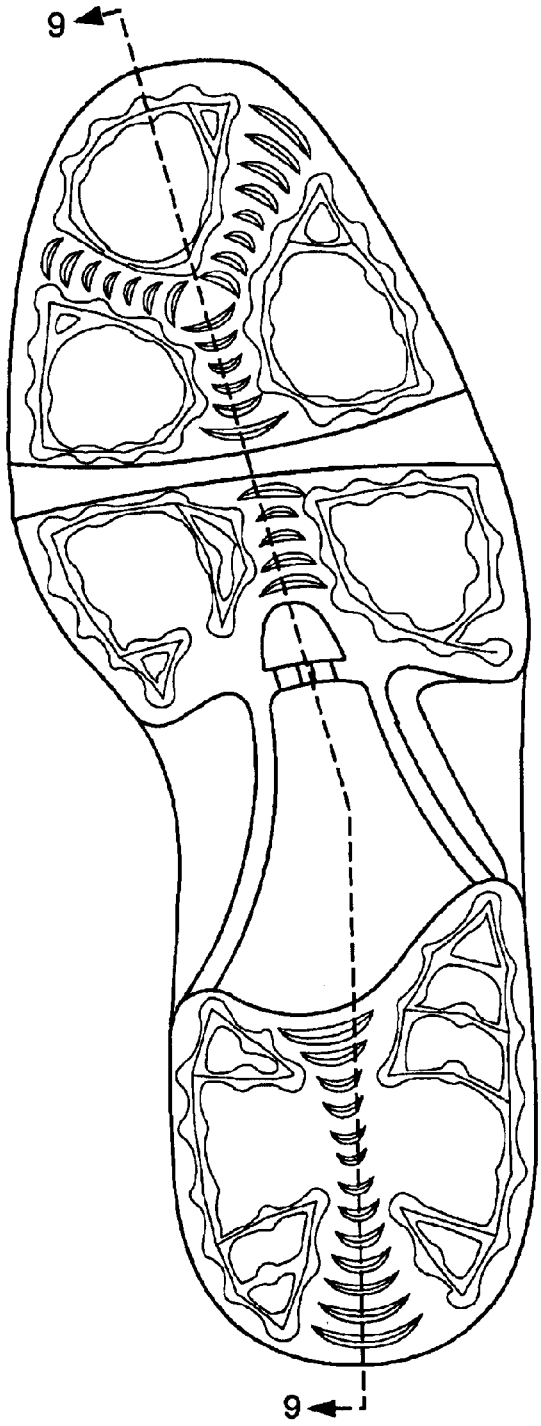
FIG. 8 is a bottom view of the outsole of FIG. 4, with the spikes disassembled therefrom, joined to a midsole of the golf shoe of FIG. 1.

Referring to FIGS. 8 and 9, the outsole 16 can be joined to the midsole 14 via a cementing process or molding process. The midsole 14 has a section 14*a* adjacent the shank section 78 that must be formed sufficiently bendable to allow the portions 20 and 22 to move with respect to one another. This can be done by varying the thickness of the midsole. The portion of the midsole 14 that is adjacent the front portion 20 has a first thickness 97. The portion of the midsole 14 that is adjacent the shank section 78 has a second thickness 98. The portion of the midsole 14 that is adjacent the heel section 80 has a third thickness 99. Preferably, the first and third thickness 97 and 99 are substantially greater than the second thickness 98. More preferably, the first thickness 97 is about 12–14 mm, the second thickness 98 is about 5–7 mm and the third thickness 99 is about 9–11 mm. The midsole 14 when joined to the outsole 16 overlies the top surface 24 (as shown in FIG. 5) and the upper surface of the gel cushion 92 (as shown in FIG. 7). Alternatively, the midsole can be bendable adjacent the shank due to selecting a material for the midsole with the proper characteristics.

Figure 10:
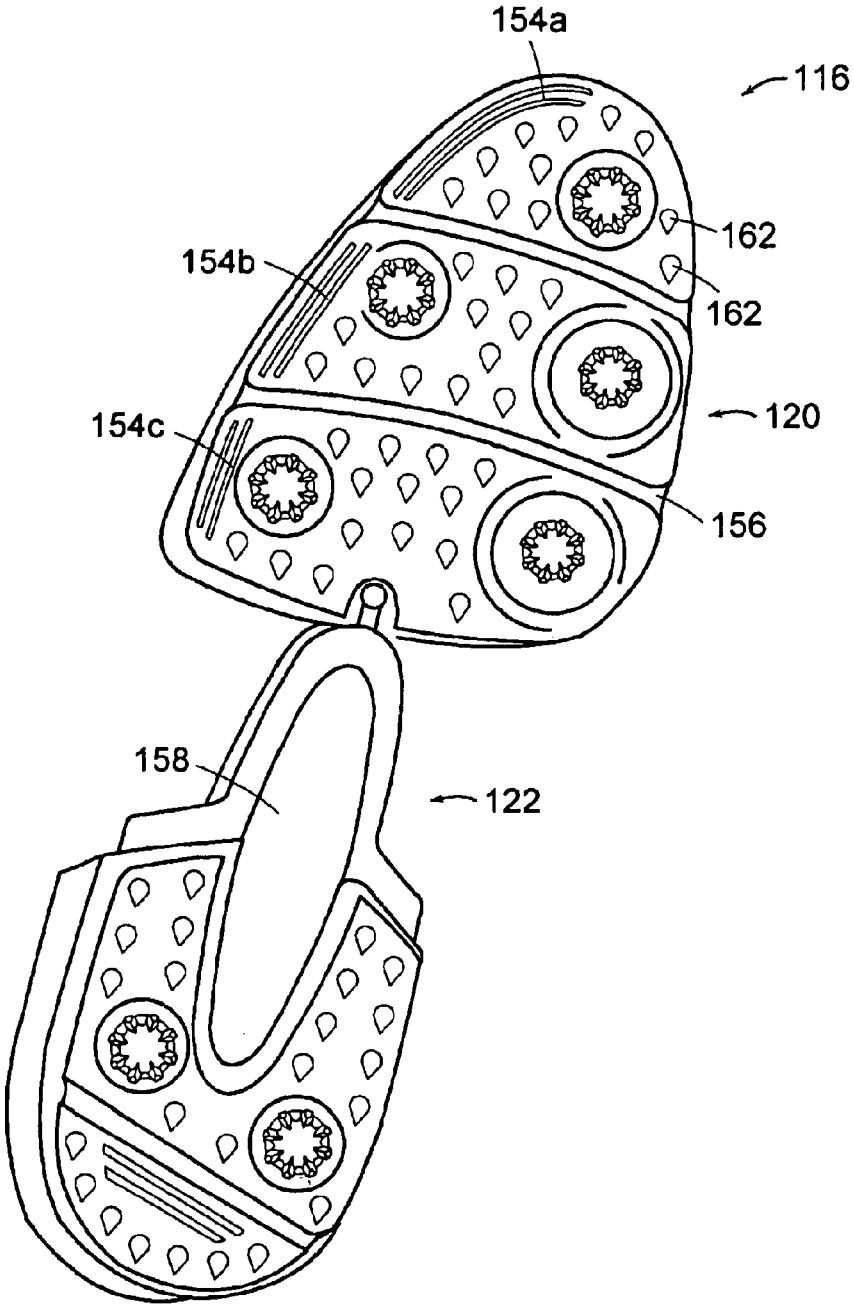
FIG. 10 is a bottom view of a second embodiment of an outsole of the present invention joined to a midsole.

Referring to FIG. 10, an alternative embodiment of an outsole 116 is shown connected to midsole 14. Outsole 116 is similar to outsole 16 previously discussed and operates similarly. Outsole 116 is formed with a forward portion 120 and rearward portion 122 connected similarly to outsole 16. Forward portion 120 however is formed of three first layer pieces 154*a–c* that are connected to one another by a second layer 156. Portions of the second layer 156 extend through the pieces 154*a–c* to form projections 162.

A logo assembly 158 is positioned along a portion of outsole 116 and includes a transparent layer material to protect the logo when the outsole contacts the ground and permit visibility of the logo. One preferred material for the logo assembly 56 is an ester-based thermoplastic polyurethane manufactured by URE-TECH CO., Ltd. under the name UTY-90A, which has a Shore A of about 90.

Figure 11:
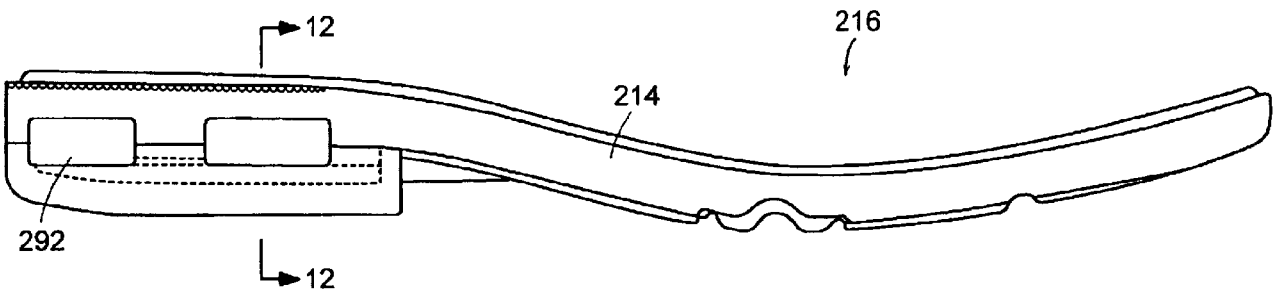
FIG. 11 is a side view of another embodiment of a gel cushion joined to an outsole and midsole of the present invention.
Figure 12:
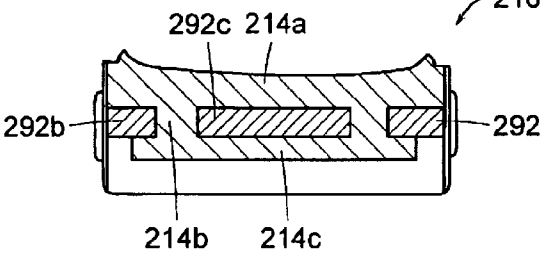
FIG. 12 is a cross-sectional view of the gel cushion, outsole and midsole along line II—II of FIG. 11.
Figure 13:
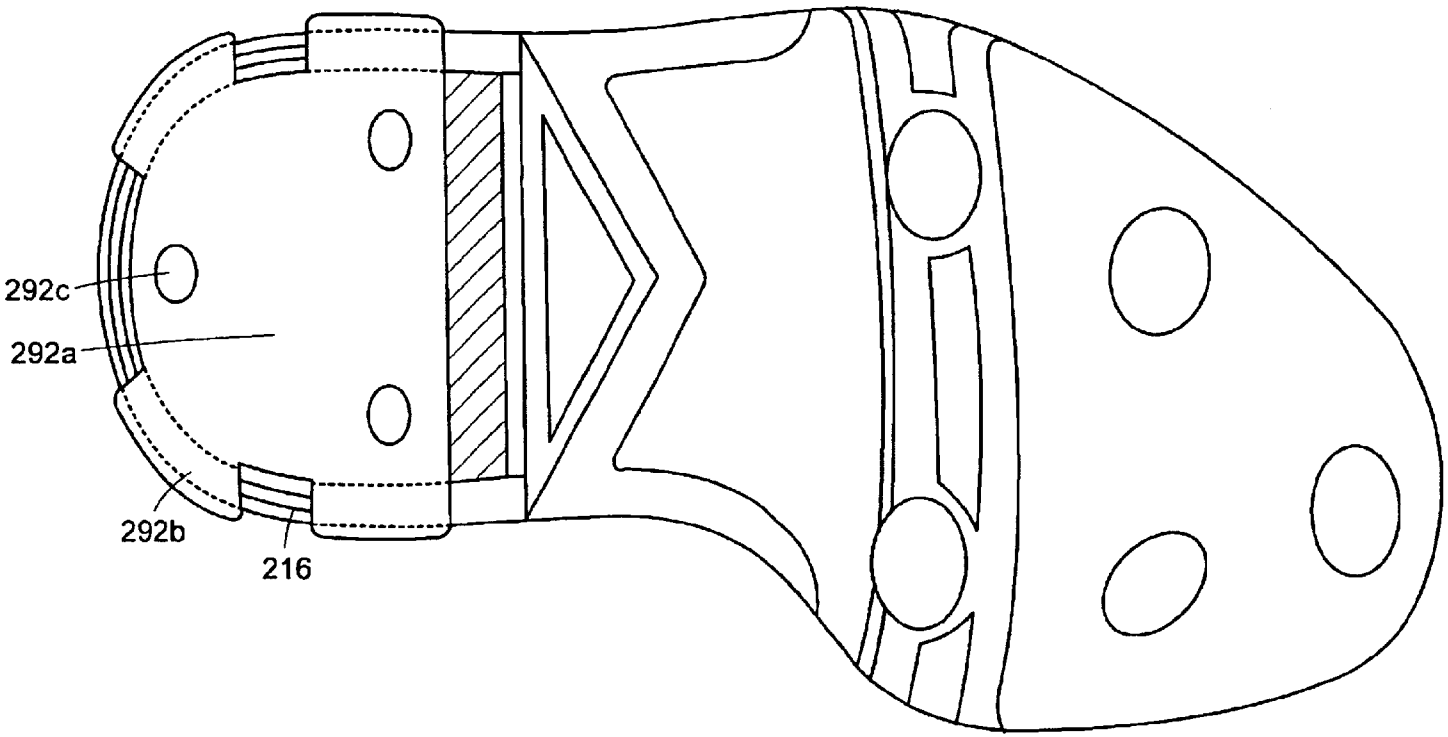
FIG. 13 is a top view of the gel cushion, outsole and midsole of FIG. 11.

Referring to FIGS. 11–13, an alternative construction of an outsole 216 is shown. Outsole 216 can include the ball-and-socket feature of outsoles 16 or 116 discussed above and operates similarly. Outsole 216 includes a gel cushion 292. Cushion 292 includes a central portion 292*a* (best seen in FIG. 13) that is configured and dimensioned so that it is disposed within the recess 86 (as shown in FIG. 5) under the midsole portion 214*a*.

The gel cushion 292 further includes extensions 292*b* that extend from the central portion 292*a* beyond the midsole 214 and outsole 216 (as best seen in FIG. 12) so that they are visible from the exterior of the shoe and contactable by a user. Although four extensions 292*b* are shown, the number and geometry of the extensions can vary in another embodiment.

The gel cushion 292 further includes three apertures 292*c* in the main body portion 292*a*. In addition, the number and geometry of the apertures 292*c* can vary in another embodiment. As shown in FIG. 12, when the midsole 214 is molded to the outsole 216 and gel cushion 292, the midsole portion 214*b* extends through the apertures 292*c* of the cushion and portion 214*a* of the midsole is above the gel cushion 292, and portion 214*c* is below the gel cushion 292. The gel for the cushion is this embodiment is not covered by a membrane, however, in another embodiment the cushion can be disposed within a membrane of material, such as plastic.

While it is apparent that the invention herein disclosed is well calculated to fulfill the objects above stated, it will be appreciated that modifications and embodiments may be devised by those skilled in the art. For example, other types of connections, such as latches or clamps may also be used in place of the ball-and-socket connection to provide independent and relative movement of the forefoot and shank-heel portions. The outsoles 16, 116 and 216, and features thereof discussed above may be used with other types of shoes, not just golf shoes. The flexible member can be used with shoes with other constructions and particularly golf shoes with or without the ball-and-socket connection. In addition, the gel cushions can be used with shoes with other constructions and particularly golf shoes with or without the ball-and-socket connection. The appended claims cover all such modifications and embodiments as fall within the true spirit and scope of the present invention.

What is claimed is:

1. An outsole comprising:

a forward portion; and a rearward portion comprised of a heel section and a shank section that are coupled to the forward portion at a pivot point located just behind a transverse arch of a user, wherein the forward and rearward portions are operatively connected to freely allow independent and relative movement of the forward and rearward portions about the pivot point while walking.

2. The outsole of claim 1, further comprising a stiff member in the shank section positioned to cover a substantial portion of the midfoot.

3. The outsole of claim 2, wherein the shank section is shaped to focus the torsional forces exerted upon the heel and shank sections toward the pivot point.

4. The outsole of claim 1, wherein the forward section is comprised of a toe piece and a forefoot piece connected together by a flexible member.

5. The outsole of claim 4, wherein the flexible member is located substantially below metatarsal bones of a user.

6. The outsole of claim 4, wherein the flexible member is located directly below metatarsal heads of a user.

7. The outsole of claim 4, wherein the flexible member is softer than the toe and forefoot pieces.

8. The outsole of claim 4, wherein the toe piece material has a Shore A hardness of greater than about 75.

9. The outsole of claim 4, wherein the forefoot piece material has a Shore A hardness of greater than about 75.

10. The outsole of claim 4, wherein the flexible member material has a Shore A hardness of less than about 85.

11. The outsole of claim 4, wherein the toe piece, the forefoot piece, and the heel section materials have a Shore A hardness of greater than about 85, and the flexible member material has a Shore A hardness of about 70.

12. The outsole of claim 1, wherein the heel section material has a Shore A hardness of greater than about 75.

13. The outsole of claim 1, wherein the forward section is comprised of a toe piece and a forefoot piece connected together by a flexible member and the shank section is comprised of a stiff member positioned to cover a substantial portion of the midfoot.

14. The outsole of claim 13, wherein the shank section is trapezoidal in shape such that it focuses torsional forces exerted on the heel and shank sections toward the pivot point.

15. The outsole of claim 1, wherein the rearward portion comprises a protrusion extending therefrom and the forward portion comprises a flexible connector defining a chamber for receiving the protrusion extending from the rearward portion.

16. The outsole of claim 15, wherein the chamber is spherical and includes an opening and a ridge disposed near the opening for resiliently maintaining the protrusion in the chamber once the protrusion is received therein.

17. The outsole of claim 16 wherein the protrusion has a ball at a free end that is received in the chamber and maintained therein by the ridge.

18. The outsole of claim 17, wherein the connector is transparent.

19. The outsole of claim 15, wherein the protrusion and chamber form a ball-and-socket connection there between.

20. The outsole of claim 19, wherein the ball-and-socket connection is configured to allow relative movement of the forward and rearward portions during walking or swinging of a golf club.

21. A sole construction comprising:

an outsole heel section comprised of a bottom surface, a front surface and an arcuate shaped side wall having an upper surface, the bottom surface, front surface and side wall defining a recess, and the outsole further having a transparent, arcuate-shaped window member on the upper surface;

a heel cushion configured and dimensioned to fit in the recess;

a midsole connected to the outsole; and a gel cushion between the heel cushion and the midsole so that at least a portion of the gel cushion is aligned with the window member.

* * * * *